United States Patent [19]

Grabner et al.

[11] 4,280,349

[45] Jul. 28, 1981

[54] ROTARY CYLINDER LOCK, ESPECIALLY FOR AUTOMOTIVE VEHICLES

[75] Inventors: Christian Grabner, Geghingen; Theodor Reinhard, Böblingen; Rolf Krügener; Hermann W. Kurth, both of Sindelfingen, all of Fed. Rep. of Germany

[73] Assignee: Daimler-Benz Aktiengesellschaft, Stuttgart, Fed. Rep. of Germany

[21] Appl. No.: 40,738

[22] Filed: May 21, 1979

[30] Foreign Application Priority Data

May 20, 1978 [DE] Fed. Rep. of Germany ..... 2822098

[51] Int. Cl.[3] ..... E05B 31/00

[52] U.S. Cl. ..... 70/358; 70/364 R; 70/364 A; 70/337; 70/441; 70/DIG. 49

[58] Field of Search ..... 70/358, 337, 364 A, 70/364 R, 416, 419, 421, 431, 439, 441, DIG. 49

[56] References Cited

U.S. PATENT DOCUMENTS

| | | | |
|---|---|---|---|
| 4,114,412 | 9/1978 | Braatx | 70/441 |
| 4,148,202 | 4/1979 | Wegrzyn | 70/431 |
| 4,186,578 | 2/1980 | Sommer | 70/419 |

*Primary Examiner*—Robert L. Wolfe

*Attorney, Agent, or Firm*—Craig and Antonelli

[57] ABSTRACT

A rotary cylinder lock with a lock cylinder rotatable in a casing, preferably a door handle housing of a motor vehicle, with the lock cylinder being pivotable into closed and open positions by at least one key associated therewith and insertable in the lock cylinder. The rotary cylinder lock is constructed such that a second key can be inserted into the lock cylinder with the second key having, at a location other than in cases of the main key, notches or projections or the like controlling additional locking members. The second key actuates, by pivoting, a switching unit which, if necessary, triggers a safety device so as to prevent unauthorized use of the motor vehicle.

10 Claims, 1 Drawing Figure

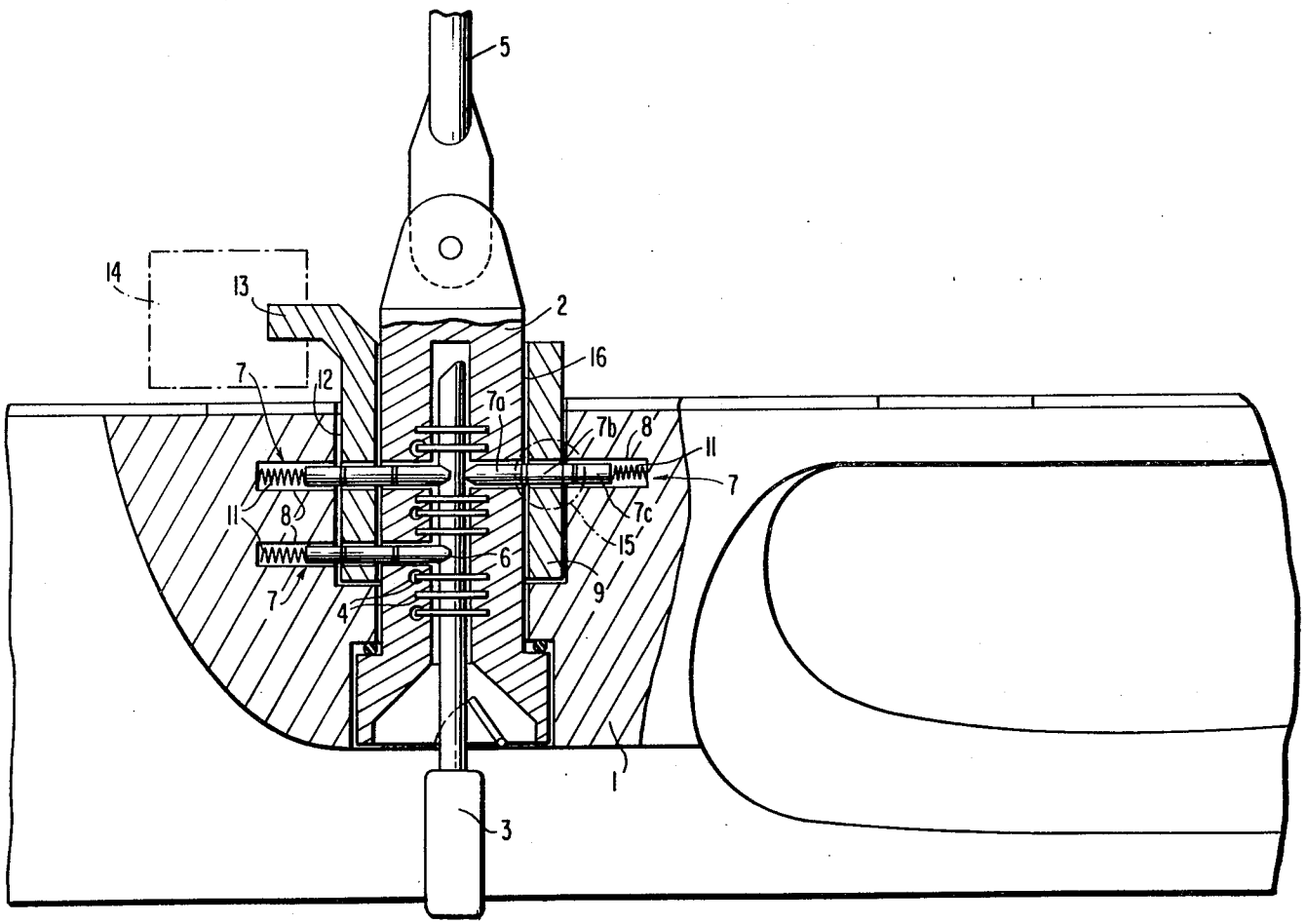
1
2
3
4
5
6
7
7a
7b
7c
8
8'
9
11
12
13
14
15
16

ROTARY CYLINDER LOCK, ESPECIALLY FOR AUTOMOTIVE VEHICLES

The invention relates to a rotary cylinder lock preferably disposed a door-handle housing of an automotive vehicle which includes a lock cylinder rotatable in a casing with the cylinder being pivotable into closed and open positions of the lock by at least one key associated therewith and insertable in the lock cylinder.

Various methods have been utilized and many suggestions have been made for safety mechanisms aimed at burglarproofing of automotive vehicles. The proposed safety mechanisms operate either with acoustic signal or light warning means activated in case of unauthorized use of the vehicle, or operating in such a way that they cut out or interrupt certain functions vital to the operation of the automotive vehicle.

However, a dissadvantage of all of the previous proposals resides in the fact that there is some indication somewhere at the vehicle that it is equipped with a burglarproofing or warning device. Either switches are visible, by means of which this warning device can be turned on or off, or parts of the warning device proper are visible in some way or another whereby the person who intends to steal the respective automobile is forewarned so that such person will then either abandon his objective, in which case the warning device has also fulfilled its purpose. However, if the person is familiar with the respective system of the warning device and also knows what to do to turn it off or to circumvent it in some other way such person will then steal the automobile.

It is an object of the present invention to provide a theftproof or burglarproof system, the presence of which cannot be detected from the outside of the vehicle and the secret of which need not be divulged even if delivering the vehicle to a garage, hotel, or the like when the car keys are surrendered so that, any thief who may approach the car is not forewarned and furthermore even the person who officially holds the car keys is not aware of the presence of a warning system and this holds true, of course, only if the warning system has been previously turned off.

This object has been attained by the invention by constructing the rotary cylinder lock in such a way that a second key, a special key, can be inserted in the lock cylinder, this special key exhibiting, at a different location than the main key, notches, projections or the like which control additional locking members and which activates, by pivoting, a switching unit which, if necessary, triggers a safety system so as to prevent unauthorized use of the automobile.

The second special key usable for activating the safety system can, in a further development of the invention, be provided, in addition to the aforementioned notches, projections, or the like, with the customary indentations just like the main key so that the car owner or another authorized user need merely use the special key if it is intended to lock the automobile and park the same with the safety system activated. If it is not desired to turn on the safety system, then such person can utilize the customary main key or the duplicate key.

To be able to fulfill the desired functions of switching on the safety system, the lock cylinder of the rotary cylinder lock can be surrounded by a sleeve which, upon actuation of the lock with the main key, is arrested with respect to a surrounding casing; whereas, the lock cylinder, when activating the lock with the special key, is arrested with respect to the sleeve and, upon pivoting of the special key the lock cylinder and the sleeve surrounding the former are pivoted together, while, in the other case, the lock cylinder alone is pivoted in the lock casing.

Furthermore, the rotary cylinder lock can be constructed so that the additional locking members are fashioned in three parts and having such lengths that, when the main key is inserted, the separating or parting lines between the inner and central parts of the additional locking members are disposed in alignment with the parting line between the lock cylinder and the sleeve; whereas when the special key is inserted the separating or parting lines between the outer and central parts of the additional locking members are in alignment with the parting line between the sleeve and the door-handle housing.

To additionally secure the vehicle, the lock cylinder can also be constructed so that it can be removed from the door handle only in a displaced functional position attainable solely by the special key. Once this functional position has been activated by the special key, the lock cylinder cannot at all be removed from the door handle, as is also known in connection with the steering wheel lock so that it is impossible for a person to learn, by removing the door handle, something about the form of the special key so as to enable such person to turn the safety system on and off.

In case of an automobile provided with a main key which is capable of locking the lockable doors, the glove compartment lock, the gasoline tank lock, the trunk lock, as well as the ignition and steering wheel lock, the lock cylinder for the ignition and steering wheel lock can be fashioned in such a way that additional tumblers are provided in this lock and additional indentations or the like are provided at the keys, which are not present in the other locks. Thereby, when a door lock is removed, the structure of the ignition-steering wheel lock cylinder cannot be fully determined at the same time.

Additionally, for space reasons, where the locking members for the special key are provided in the door lock, it is possible to arrange the tumblers corresponding to the tumblers in the ignition-steering wheel lock so as to make it impossible to determine the structure of the ignition steering wheel lock in the event the lock cylinder is removed from the door.

The invention will be explained in greater detail in the following description with reference to an embodiment illustrated in the drawing and wherein:

The single FIGURE of the drawing is a partially schematic cross-sectional view of a rotary cylinder lock arrangement in accordance with the present invention.

Referring now to the single FIGURE of the drawing, according to this figure, a rotary cylinder lock is seated in a door-handle housing 1 and has a lock cylinder 2 supported in the housing 1. The lock cylinder 2 is pivotable into the closed and open positions of the lock by means of an inserted key 3. The lock cylinder 2 has the usual tumblers 4 which can be placed, by inserting the associated key, into a position by means of which the lock cylinder 2 and thus also the transmission rod 5 can be pivoted with the pivoting action locking or unlocking the door lock (not shown).

The key 3 illustrated in the drawing is constructed as a special key and, in addition to the customary indentations, notches, or the like, it is also provided with special notches 6 adapted to be engaged by inner parts *7a* of locking members generally designated by the reference numeral 7. A sleeve 9 surrounds the lock cylinder 2 and the locking members 7 are guided in bores 8 penetrating coaxially the lock cylinder 2, the sleeve 9, and part of the door-handle housing 1. The locking members 7 are urged by the springs 11 in a direction toward a center of the lock cylinder 2.

The locking members 7 are divided into three parts *7a, 7b, 7c* by way of separating or parting lines. Upon an insertion of the special key 3, the three-part locking members 7 assume the position shown on the left-hand side of the drawing so that a parting line between the central part *7b* and the outer part *7c* of the locking members 7 is in alignment with a parting line 12 resulting between the sleeve 9 and the door-handle housing 1. Upon a pivoting of the special key 3, the lock cylinder 2 as well as the sleeve 9 surrounding same are simultaneously pivoted. Thus, the door lock is opened or closed by the transmission rod 5. The sleeve 9 includes an arm 13, which arm is likewise pivoted upon a pivoting of the sleeve 9. The arm 13 is in operative connection with a siwtch 14 with the actuation of the switch causing a safety or warning device (not shown) to be turned on or off.

The main key or the second key have no notches at the locations where additional notches 6 are provided in the special key 3, so that the locking members 7, upon the insertion of the normal main or twin key, can only advance up to the smooth places of the second keys as most clearly illustrated in the detailed view designated 15.

As shown in the detailed view designated 15 member *7a* can only advance up to a planar place of the normal main or twin key, where no notch is provided. Thereby, the parting line between the inner locking member *7a* and the central locking member *7b* arrives at the level of the parting line 16 between the lock cylinder 2 and the sleeve 9 so that now, during a pivoting of the normal main or duplicate key, only the lock cylinder 2 by itself is being pivoted, while the sleeve 9 is prevented from pivoting with respect to the door-handle housing 1 by means of the central locking member *7b*.

Since the special key 3 differs from the customary main and duplicate keys only by the additional notches 6, the special key 3 also fits into all cylinders of the remaining locks which fit the normal key and, at those places, the additional notches 6 do not trigger a special function, because no locking members are arranged in the normal locks at the respective locations.

To avoid having to arrange additional space for the locking members 7, it is possible to omit, at the door handles which had the special function of actuating a safety or warning device, the customary tumblers 4 in the zone of the locking members 7 whereas, for example, at the steering wheel lock, these customary tumblers are again present. This provides the advantage that, by disassembling the door handle with the special function of actuating the safety or warning device no full conclusion can be drawn to the construction of the steering wheel lock cylinder.

By the way, the lock cylinder 2 can also be constructed so that it can be removed from the door handle only in a functional position attainable solely by the special key 3 so that it is impossible to gain knowledge about the form of the special key 3 by removing the door handle.

In the special key 3, the locking members 7 need not necessarily be arranged along the narrow side of the key 3 but can also be operative on the broad side thereof. It is also possible to dispose the special locking members 7 and the corresponding notches 6 at a location where the customary indentations are provided, namely, respectively between such indentations, and in this way, the locking members 7 required for the special function would operate in the same direction as the customary tumblers 4.

What is claimed is:

1. A rotary cylinder lock arrangement for a motor vehicle equipped with a safety means for at least one of providing an alarm and for interrupting at least one function vital to an operation of the motor vehicle, the arrangement comprising a lock cylinder means rotatably mounted in a casing, tumbler means arranged in the lock cylinder means, and at least one first key means for controlling a positioning of the tumbler means and for rotating the lock cylinder means into open and closed positions, characterized in that additional locking means are operatively connected with the lock cylinder means and the safety means, and at least one second key means adapted to be inserted into the lock cylinder means is provided for controlling both a positioning of the tumbler means and for controlling a positioning of the additional locking means such that an insertion and rotation of only the second key means results in an actuation of the safety means so as to prevent unauthorized use of the motor vehicle.

2. An arrangement according to claim 1, characterized in that the first key means is provided with a plurality of notches adapted to cooperate with the tumbler means, and in that the second key means is provided with notches corresponding to the notches of the first key means as well as additional means cooperable with the additional locking means so as to control a positioning thereof.

3. An arrangement according to one of claims 1 or 2, characterized in that a sleeve means surrounding the lock cylinder means is provided for operatively connecting the safety means with the additional locking means, the sleeve means is mounted so as to be able to rotate relative to the lock cylinder means, and in that the sleeve means and the lock cylinder means rotate together upon an insertion and rotation of the second key means but upon an insertion and rotation of the first key means only the lock cylinder means rotates and the rotation of the sleeve means is prevented by the additional locking means.

4. An arrangement according to claim 3, characterized in that a separating line is provided between the lock cylinder means and the sleeve means and between the sleeve means and the casing, the additional locking means includes a plurality of individual locking members each formed by a plurality of parts, means are provided in the lock cylinder means, sleeve means, and casing for coaxially accommodating the plurality of parts of the respective locking members, and in that the individual parts each have a predetermined length such that upon an insertion of the first key means a separating line between parts of the respective locking members are in alignment with the separating line between the lock cylinder means and the sleeve means, and upon the insertion of the second key means a separating line between the parts of the respective locking members are in alignment with the separating line between the sleeve means and the casing.

5. An arrangement according to claim 4, characterized in that each of the locking members are formed of a central part and inner and outer parts adjoining respective sides of the central part, and in that upon insertion of the first key means a separating line between the inner and central parts of the locking members are in alignment with the separating line between the lock cylinder means and the sleeve means, and upon insertion of the second key means a separating line between the outer and central parts of the locking members are in alignment with the separating line between the sleeve means and the casing.

6. An arrangement according to claim 5, characterized in that the lock cylinder means is disposed in the casing so as to be removable only in a functional position attained by an insertion of the second key means.

7. An arrangement according to claim 6, wherein the motor vehicle includes an ignition and steering wheel lock means having a plurality of tumbler means, characterized in that the number of tumbler means arranged in the lock cylinder means is less than the number of tumbler means in the ignition and steering wheel lock means whereby a removal of the lock cylinder means from the casing precludes a determination of an arrangement of the tumbler means in the ignition and steering wheel lock means.

8. An arrangement according to claim 7, wherein the vehicle includes lockable doors, a glove compartment lock, a gasoline tank lock, a trunk lock, each of which includes a plurality of tumbler means, characterized in that the number of tumbler means in the cylinder lock means corresponds to the number of tumbler means in the additional locks.

9. An arrangement according to claim 7, characterized in that the locking members of the additional locking means are provided at positions of the cylinder lock means corresponding to positions of the additional tumbler means in the ignition and steering wheel lock means.

10. An arrangement according to claim 9, characterized in that the casing is a door handle housing of the motor vehicle.

* * * * *